US007026896B2

(12) United States Patent
Mikl et al.

(10) Patent No.: US 7,026,896 B2
(45) Date of Patent: Apr. 11, 2006

(54) RELAY WITH A CORE HAVING AN ENLARGED CROSS-SECTION

(75) Inventors: Rudolf Mikl, Arbesthal (AT); Leopold Mader, Moedling (AT); Bernd Adrian, Krems (AT); Johannes Helmreich, Zwettl (AT)

(73) Assignee: Tyco Electronics Austia GmbH, Vienna (AT)

( * ) Notice: Subject to any disclaimer, the term of this patent is extended or adjusted under 35 U.S.C. 154(b) by 0 days.

(21) Appl. No.: 10/786,407

(22) Filed: Feb. 25, 2004

(65) Prior Publication Data

US 2004/0227600 A1 Nov. 18, 2004

(30) Foreign Application Priority Data

Mar. 6, 2003 (EP) ..... 03005059

(51) Int. Cl.
*H01H 51/22* (2006.01)

(52) U.S. Cl. ..... 335/85; 335/128

(58) Field of Classification Search ..... 335/78–86, 335/124, 128–131, 220–234
See application file for complete search history.

(56) References Cited

U.S. PATENT DOCUMENTS

| | | | | |
|---|---|---|---|---|
| 2,539,547 | A | 6/1951 | Mossman et al. | |
| 3,497,845 | A | 2/1970 | Bernier | |
| 5,084,688 | A * | 1/1992 | Martino | 335/78 |
| 5,627,503 | A | 5/1997 | Mader | |
| 5,945,900 | A * | 8/1999 | Shibata et al. | 335/234 |

FOREIGN PATENT DOCUMENTS

| | | |
|---|---|---|
| DE | 42 32 228 A1 | 4/1993 |
| EP | 0 202 651 A3 | 11/1986 |
| EP | 0 202 651 B1 | 11/1986 |
| EP | 0 363 176 B1 | 4/1990 |
| EP | 0 691 667 B1 | 1/1996 |
| WO | WO 00/24019 | 4/2000 |

* cited by examiner

*Primary Examiner*—Lincoln Donovan
(74) *Attorney, Agent, or Firm*—Barley Snyder LLC

(57) ABSTRACT

The invention relates to a relay comprising a coil bobbin, a core penetrating the coil bobbin and a yoke. To achieve a high switching force with a low overall height, the cross-sectional area of the core is greater in the region toward the transition to the yoke than in the central region of the coil bobbin. Increased magnetic flux can be conveyed from the core owing to the cross-sectional enlargement and at the same time more coil windings can be arranged in the central region owing to the reduced cross-section there. Both measures act together and allow high switching forces with low overall height.

13 Claims, 5 Drawing Sheets

RELAY WITH A CORE HAVING AN ENLARGED CROSS-SECTION

FIELD OF THE INVENTION

The invention relates to a relay with a coil bobbin, a core penetrating the coil bobbin and a yoke.

BACKGROUND

Relays with a coil bobbin, a core penetrating the coil bobbin and a yoke are known, for example, from EP-A-202 651, EP-B-363 176, EP-B-691 667 and DE-C-42 32 228.

In all of these relays the coil bobbin, the core and the yoke form a magnetic system that induces a switching process when the coil is excited or energized. During the switching process, the excited coil, generates a magnetic switching force that moves an armature. The movement of the armature is transmitted to a spring contact which then closes (makes) or opens (breaks) electrical contact with one or more fixed contacts.

One disadvantage of the relays from these known references is that it is difficult to provide adequate switching force with a compact construction.

The object of the invention is therefore to improve a switching relay such that large switching forces are achieved with a small overall volume.

SUMMARY OF THE INVENTION

This and other objects are achieved by a relay according to an embodiment of the invention having a core with a greater cross-sectional area in the region of the transition to the yoke than in the central region of the core surrounded by the coil bobbin.

This solution is simple in terms of construction and leads to smaller overall constructions of the relay with a constantly high switching force.

According to an exemplary embodiment of the invention, the central region of the core, which is surrounded by the coil bobbin, has a reduced cross-section providing space for additional coil windings, so the coil can generate a higher magnetic force. In the transition region between the yoke and core the cross-section is, on the other hand, designed so as to widen, so high magnetic flux can be conveyed from the core to the yoke. Both measures—the cross-sectional enlargement in the transition region between core and yoke and the cross-sectional reduction and the increased winding space for the coil bobbin—optimally supplement one another when a higher switching force is generated.

The invention will be described by way of example hereinafter with reference to various embodiments and to the accompanying drawings. The various features in the individual embodiments can be combined here independently of one another, as has already been illustrated above in the individual advantageous designs.

BRIEF DESCRIPTION OF THE DRAWINGS

Exemplary embodiments of the invention will next be described with reference to the drawings, in which.

DETAILED DESCRIPTION OF THE INVENTION

Figure 1:
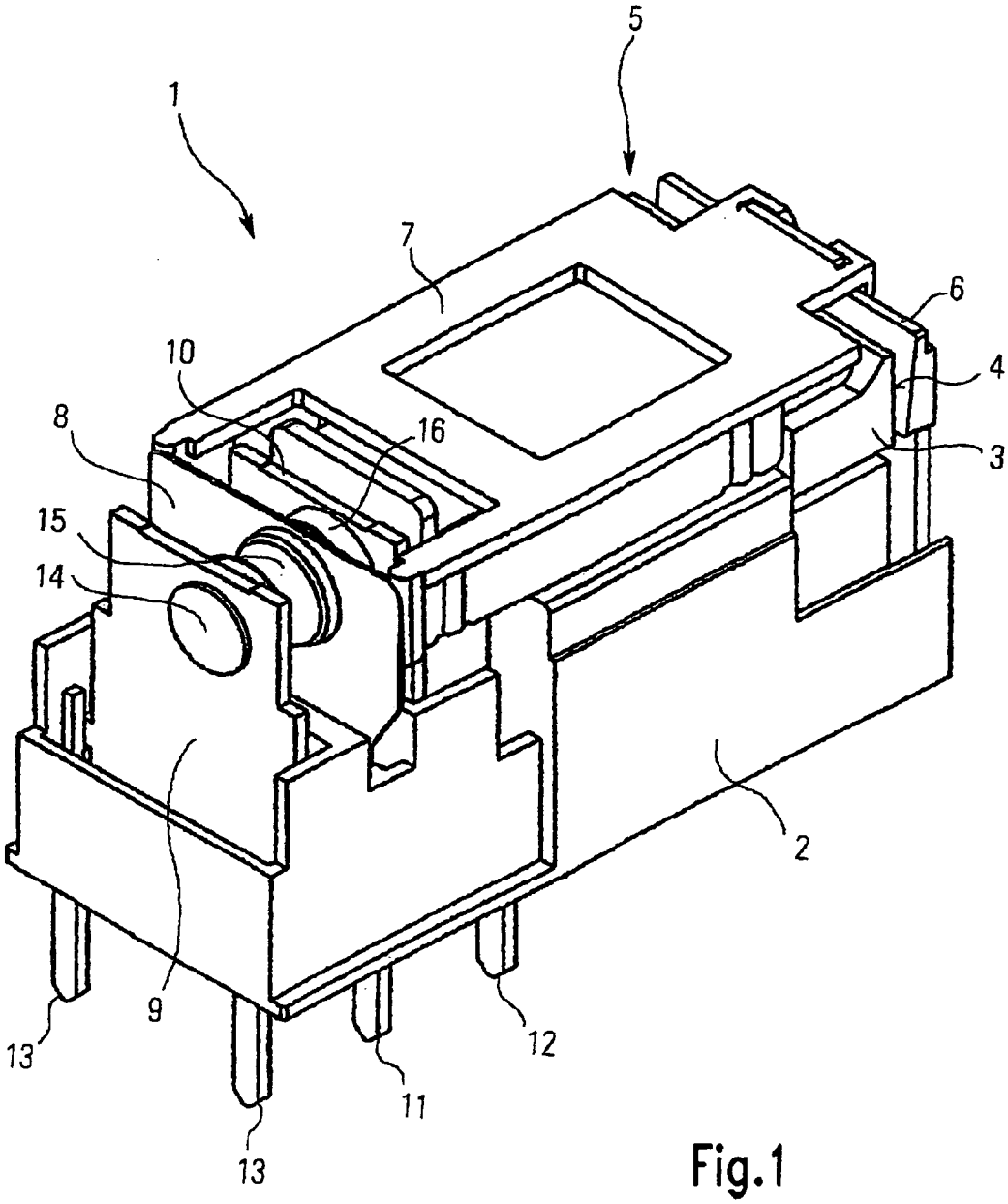
FIG. 1 is a perspective view of a relay according to an exemplary embodiment of the invention.

The general construction of a relay will firstly be described with reference to FIG. 1.

A relay 1 comprises a coil (not shown in FIG. 1) wound on a coil bobbin 2, a yoke 3, and a core (not shown in FIG. 1) penetrating the coil bobbin 2. The yoke 3 ends in a pole face 4 adjoining a working air gap 5. In other designs the pole face 4 can also be formed on the core.

The working air gap 5 is arranged between the pole face 4 and a movable armature 6. The armature 6 is connected to a spring contact 8 so as to transmit movement, via a connecting element 7 guided along the coil bobbin 2, so that a movement of the armature 6 inevitably leads to a movement of the spring contact 8.

The spring contact 8 is in turn arranged between two fixed contacts 9, 10 arranged at a distance from one another in the movement direction of the spring contact, wherein the spring contact can preferably only touch one of the two fixed contacts 9, 10 respectively. The spring contact 8 is conventionally biased such that in the force-free state it rests against one of the fixed contacts, for example contact 10.

If an excitation current is passed through the coil, a magnetic force is produced at the pole face 4, which force attracts the armature 6 and attempts to reduce the working air gap. As a result, the armature 6 moves out of its resting position. This movement is transmitted to the spring contact 8 via the connecting element 7. The spring contact 8 consequently also moves from its resting position and is pressed against the contact 9.

The spring contact 8 and fixed contacts 9, 10 are each provided with contact pins 11, 13, 12, respectively, extending to the outside of the relay. The contact pins 11, 12, 13 can each be present in pairs.

The contacts 11, 12, 13 form contact pairs 11, 13 and 11, 12 that are opened and closed as a function of the position of the spring contact 8. For example in the exemplary resting position of the spring contact 8 shown in FIG. 1, the contacts 11 and 12 are electrically connected to one another via the spring contact 8 and the fixed contact 10.

To provide defined contact points at the fixed contacts 9, 10 and the spring contact 8, contact points or projections 14, 15, 16 are provided at the contacts 9, 10 and/or the spring contact 8.

Figure 2:
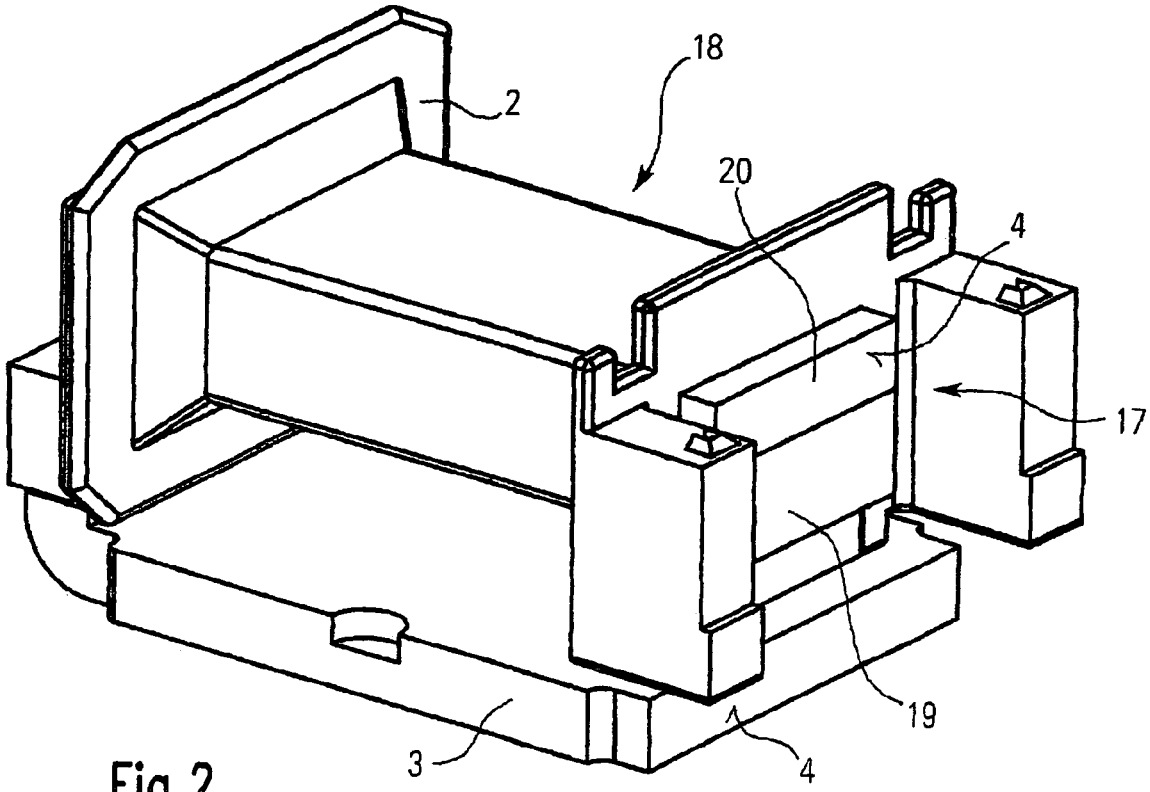
FIG. 2 shows a coil bobbin, a core and a yoke of a relay according to an exemplary embodiment of the invention.

FIG. 2 shows an embodiment of the coil bobbin 2 with the yoke 3 and with the core 17 penetrating the coil, the viewing direction being oriented obliquely onto the pole face 4.

For clarity, the coil, which is held by the coil bobbin 2 in the recess 18, winding around the coil bobbin 2 and extending in the axial direction of the coil bobbin 2, has been omitted in FIG. 2.

As can be seen in FIG. 2, the core 17 comprises two core elements 19, 20 located abutting one another along a parting plane 26 (shown in FIG. 3) and extending transversely to the coil winding direction.

The core 17 projects from the coil bobbin 2 in the longitudinal direction thereof.

Figure 3:
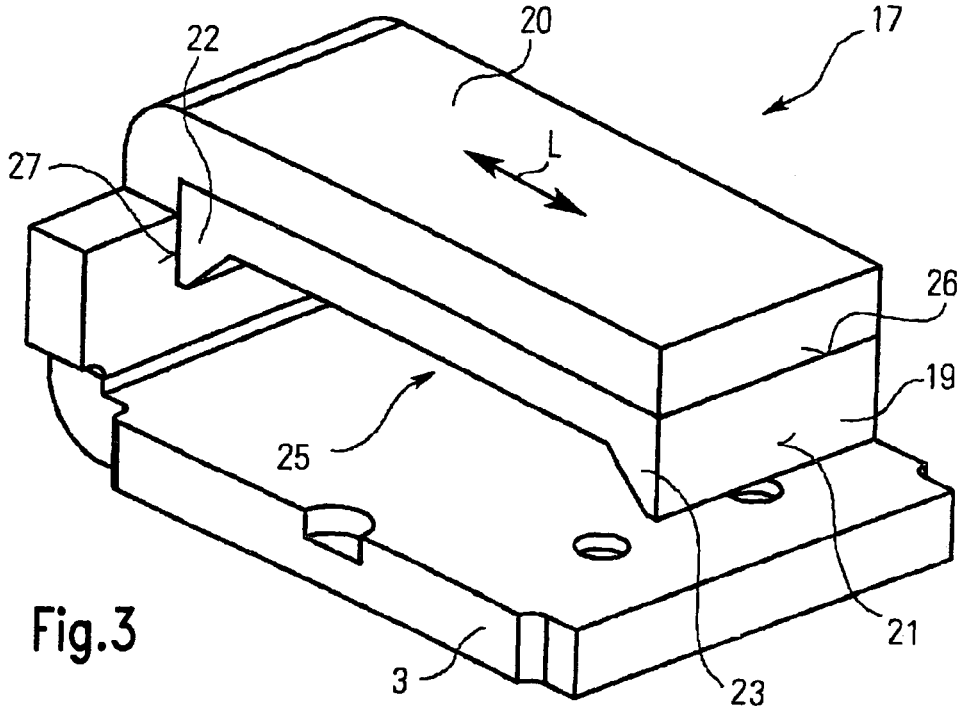
FIG. 3 shows the core and the yoke of the embodiment of FIG. 2.

FIG. 3 shows the yoke 3 and the core 17 in the perspective of FIG. 2 with the coil bobbin 2 removed.

It can be seen that the one core element 20 is designed integrally with the yoke 3 while the other core element 19 abuts the yoke 3 and the core 20. The two core elements 19, 20 terminate flush with each other, toward the armature, to form a substantially level end face 21 which can also be used as the pole face 4.

In the exemplary embodiment, the core elements 20 is integral with the yoke 3, and is substantially uniformly rectangular in cross-section and does not have any projections and/or undercuts.

The other, separate core element 19 is provided with cross-sectional enlargements 22, 23 at the respective end faces in the longitudinal direction L of the coil. The cross-sectional enlargements 22, 23 can engage on the ends of the coil bobbin 2.

In the central region of the core 17, which is surrounded by the coil bobbin 2, the cross-section of the core is reduced with respect to the two end regions located in the longitudinal direction of the coil bobbin. As a result, a recess 25 is produced in the core 17 which can be used as additional winding space for the coil, so the coil has a higher number of windings and/or density of windings.

If the core 17 does not adjoin the working air gap 5 of the relay 1 (because the pole face 4 is formed by the yoke), the cross-sectional enlargement 23 can be dispensed with although, as a consequence, the flux of the magnetic field from the core into the armature is affected. Of course, the pole face 4 formed by the yoke 3 can also have a cross-sectional enlargement.

As can also be seen in FIG. 3 the parting plane 26 between the two core elements 19, 20 extends in the longitudinal direction L of the coil parallel to the yoke 3. The faces located one on top of the other at the parting plane 26, and at the abutment face 27 between the cross-sectional enlargement 22 and the yoke 3 are designed so as to be as flat and smooth as possible. As a result, air gaps in the transitional regions and losses in the magnetic flux are minimized or avoided.

Figure 6:
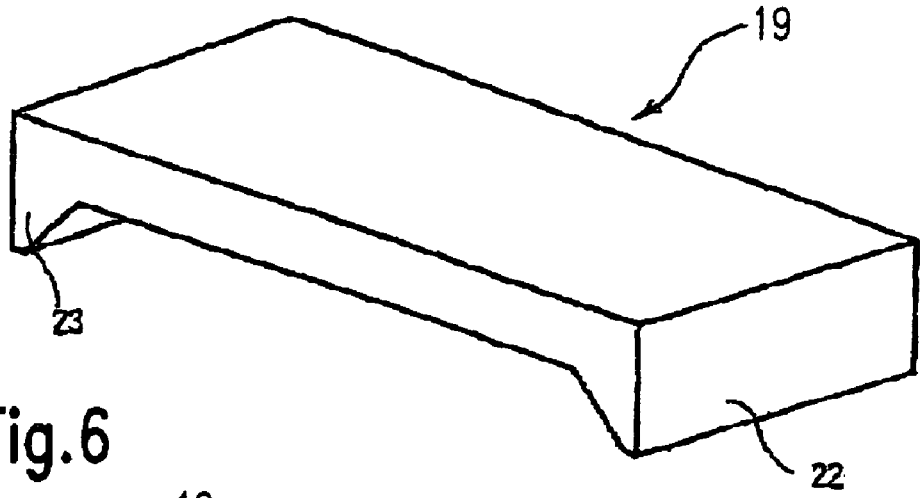
FIG. 6 shows a further alternative exemplary core element for a relay according to the invention.
Figure 5:
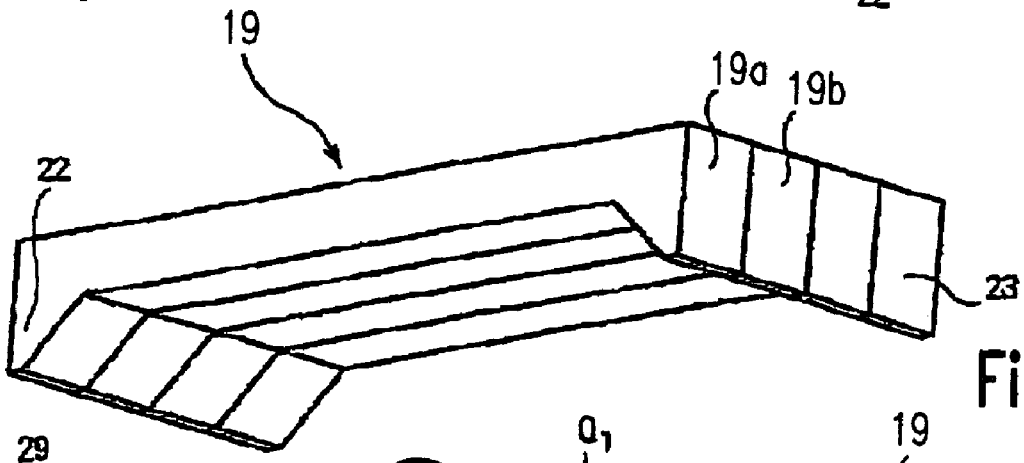
FIG. 5 shows an alternative exemplary core element for a relay according to the invention.
Figure 4:
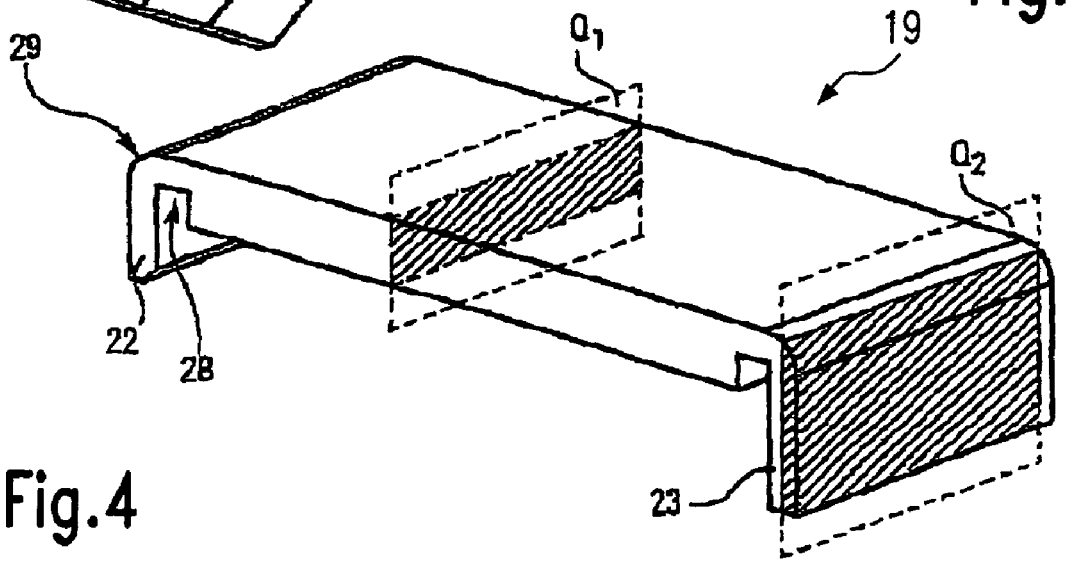
FIG. 4 shows an exemplary core element for a relay according to the invention.

FIG. 4 to 6 show further embodiments of the core element 19. In all of these core elements 19 the cross-section at the two ends 22, 23 located in the longitudinal direction is enlarged in a cross-sectional plane perpendicular to the longitudinal direction L.

The cross-sectional plane Q is shown in FIG. 4, once in the central region as the cross-sectional plane Q1 and once in the end region as the cross-sectional plane Q2. As can be seen, the area of the core element 19 in the cross-sectional plane Q2 is greater than the area in the cross-sectional plane Q1.

The core element 19 of FIG. 4 is economically produced from one piece and comprises bent ends 22, 23. The bending process is facilitated by a recess 28 in the vicinity of the bending radius 29 and extending over the entire width of the core element 19.

FIG. 5 shows a core element 19 constructed from a plurality of individual elements 19*a*, 19*b*, etc. arranged side-by-side. The number of core elements 19*a*, 19*b*, etc. arranged side-by-side and preferably touching may be varied; FIG. 5 shows, merely as an example, four elements located side-by-side. The cross-sectional areas or contours of the individual core elements 20*a*, 20*b*, etc. are identical in a plane located in the longitudinal direction L. To be able to easily handle the core element 19 in the embodiment of FIG. 5, the core elements 19*a*, 19*b*, etc. may be connected to one another into one piece, for example by gluing, soldering, or welding.

In the embodiment of FIG. 6 the core element 19 is a stamped part made of a metal material in which the two cross-sectional enlargements 22, 23 are designed in the form of impressed ramps extending obliquely in the longitudinal direction L of the coil. Alternatively, the core element 19 with oblique ramps can also be produced by injection moulding.

Figure 7:
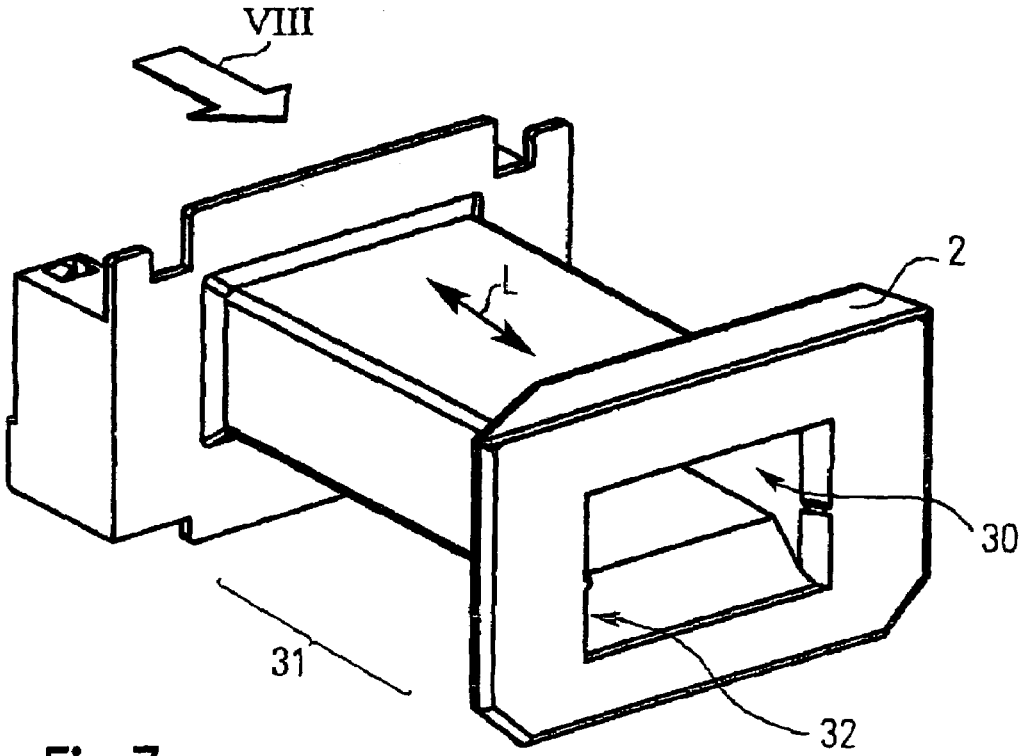
FIG. 7 shows an exemplary coil bobbin for a relay according to the invention.
Figure 9:
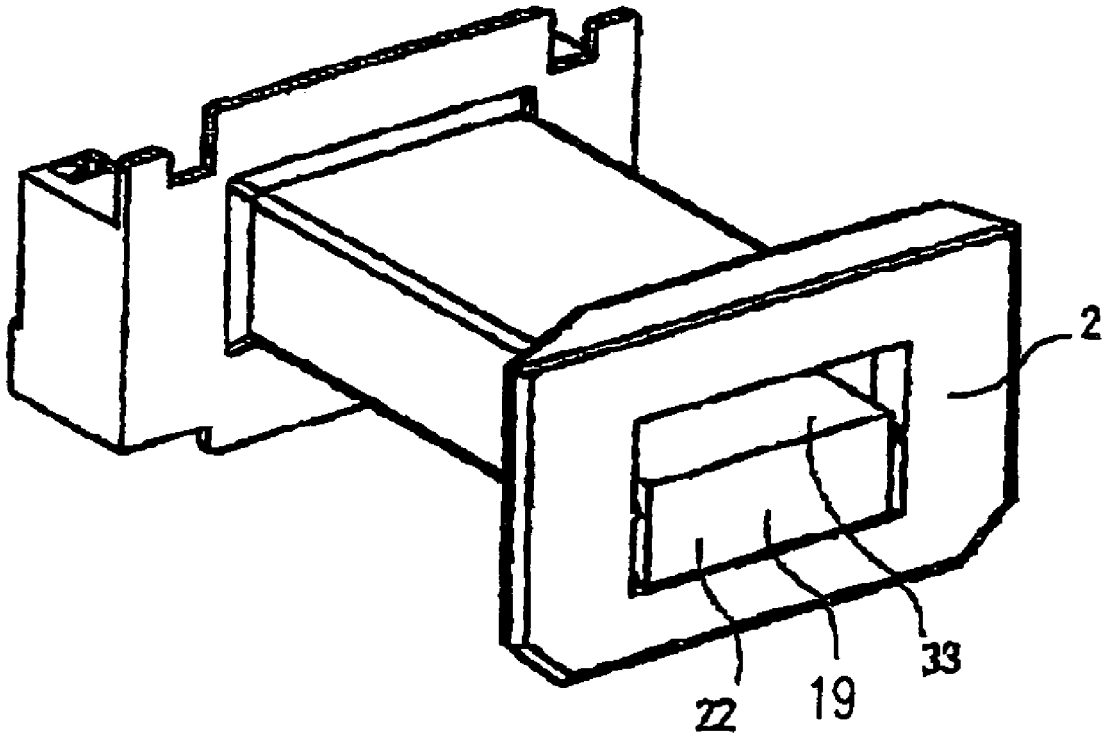
FIG. 9 shows an exemplary coil bobbin with inserted core element according to an embodiment of the invention.

FIG. 7 shows the coil bobbin 2 with the core 17 and the yoke 3 omitted. The coil bobbin 2 has a passage 30 extending in the longitudinal direction L of the coil and open at both ends.

In the central region 31 of the coil bobbin 2, which substantially coincides with the recess 18 for the coil, the internal cross-section is reduced in a plane perpendicular to the longitudinal direction L of the passage 30 in order to create space for additional coil windings. The passage 30 widens in a region 32 located toward the two ends of the coil bobbin 2. The form of the region 32 is adapted to the form of the respective cross-sectional enlargement 22, 23 so the core element 19 can be received in the passage 30 with the cross-sectional enlargements 22, 23. The cross-section of the passage 30 is dimensioned at its smallest point such that the cross-sectional enlargement 22 of the core element 20 can still be pushed through the passage 30. In the inserted state, the cross-sectional enlargements 22, 23 engage behind the coil bobbin 2 so the core element 19 is held substantially non-displaceably by the coil bobbin.

Figure 8:
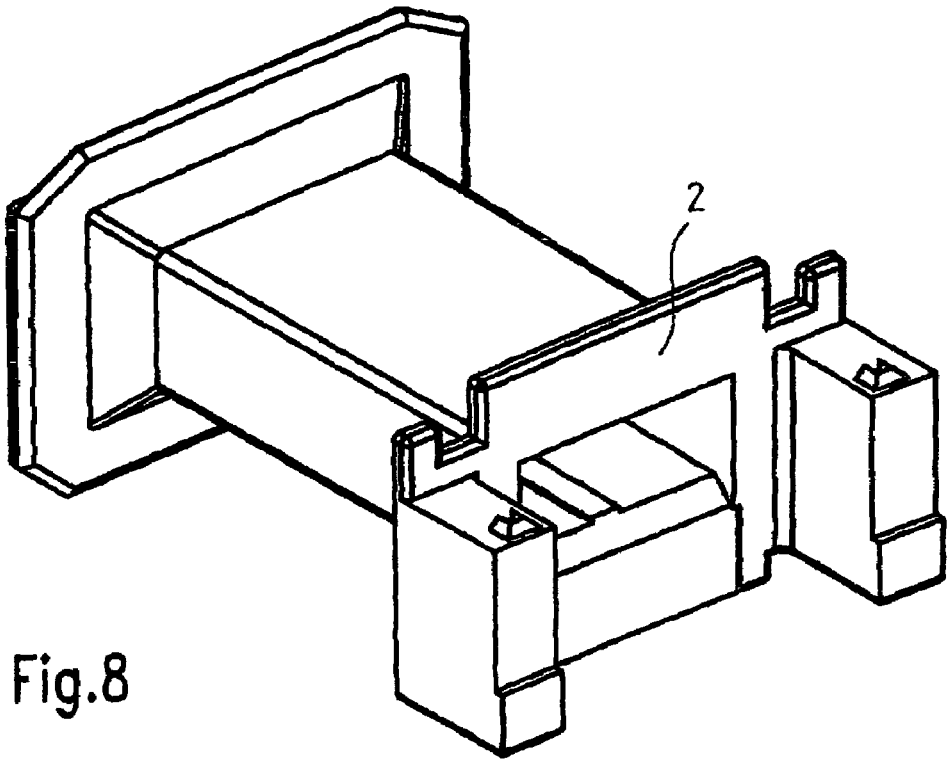
FIG. 8 shows the coil bobbin of FIG. 7 in a view from the direction of arrow VIII.

As shown in FIG. 8, in which the coil bobbin 2 of FIG. 7 is illustrated in the viewing direction VIII, the cross-sectional enlargement of the passage 30 can be differently designed at the two open ends in order, for example, to allow a flush termination of the core with the coil bobbin 2 at the one end and protrusion of the core 17 at the other end.

When the core element 19 with cross-sectional enlargements 22 and 23 is inserted into the passage 30, the cross-sectional enlargements 22, 23 are received in enlarged regions 32 and a free space 33 extending through the coil bobbin 2 and of substantially constant internal width remains. The other core element 20 can then be inserted into the free space 33. Held by the cross-sectional enlargements 22, 23, the core element 19 can no longer be removed from the passage 30 as long as the other core element 20 is inserted. The core can be rigidly held in the coil member by a press fit of the core element 20. For this purpose, the cross-section of the core element 20 is somewhat larger than the cross-section of the free space 33.

The assembly process of a relay according to the invention will be briefly described hereinafter.

First, the core element 19 provided with at least one cross-sectional enlargement 22, 23 is inserted into the passage 30 in the coil bobbin 2. As soon as the cross-sectional enlargements 22, 23 are received in the enlarged region 32 of the passage 30, the other core element 20 can be inserted into the space 33 still free.

Depending on whether the cross-sectional enlargements 22, 23 are designed in one piece on the yoke 3 or on the separate core element 19, the yoke 3 or the core element 19 is firstly placed in the passage 30. The core element 20 with substantially uniform rectangular cross-section is then inserted.

What is claimed is:

1. A relay comprising:

a coil bobbin;

a yoke; and a core penetrating the coil bobbin and connected to the yoke; the core having a pair of cross-sectional enlargements located along end faces thereof, each having a first cross-sectional area; the core having a central region located between the cross-sectional enlargements and surrounded by the coil bobbin, the central region having a second cross-sectional area, the first cross-sectional area being greater than the second cross-sectional area.

2. The relay according to claim 1, wherein the core is tapered in a region surrounded by the coil bobbin.

3. The relay according to claim 1, wherein the core is formed from at least two core elements.

4. The relay according to claim 1, wherein the core is formed from at least two core elements, at least one core element has a non-uniform cross-sectional area, and the core element having a non-uniform cross-sectional area sized to be insertable into the coil bobbin.

5. The relay according to claim 3, wherein the core elements are substantially free of undercuts.

6. The relay according to claim 3, wherein the yoke is integral with one of the core elements.

7. The relay according to claim 6, wherein the core element that is integral with the yoke is substantially uniform and rectangular in cross-section.

8. The relay according to claim 7, wherein the core element that is integral with the yoke is insertable into the coil bobbin with the non-uniform core element present in the coil bobbin.

9. The relay according to claim 1, wherein at least two core elements are provided, of which the cross-section widens toward the yoke.

10. The relay according to claim 1, wherein one of the end faces of the core forms a pole face for the relay.

11. The relay according to claim 10, wherein at least two core elements are provided, of which the cross-section widens toward the pole face.

12. The relay according to claim 3, wherein at least one core element touches the yoke.

13. The relay according to claim 1, wherein at least one cross-sectional enlargement engages with the coil bobbin.

* * * * *